United States Patent [19]

Klara et al.

[11] 4,176,763

[45] Dec. 4, 1979

[54] MAGAZINE FOR TRANSFERRING ROD-SHAPED ARTICLES

[75] Inventors: Charles J. Klara, Bethlehem; James H. Hohl, Wescoesville, both of Pa.; Wilbur L. Clymer, Phillipsburg, N.J.

[73] Assignee: Binney & Smith Inc., Easton, Pa.

[21] Appl. No.: 846,896

[22] Filed: Oct. 31, 1977

Related U.S. Application Data

[63] Continuation-in-part of Ser. No. 738,489, Nov. 3, 1976, abandoned.

[51] Int. Cl.[2] ..... B65H 3/40

[52] U.S. Cl. ..... 221/93

[58] Field of Search ..... 221/91, 94, 93, 300, 221/298, 242; 53/151, 152, 153

[56] References Cited

U.S. PATENT DOCUMENTS

| | | | |
|---|---|---|---|
| 1,747,387 | 2/1930 | Paulson et al. | 221/242 |
| 2,682,983 | 7/1954 | Ashcroft | 221/93 X |

*Primary Examiner*—Stanley H. Tollberg
*Attorney, Agent, or Firm*—Norbert P. Holler

[57] ABSTRACT

A magazine for receiving a plurality of elongate, generally rod-shaped articles from a first or source location where such articles are arranged in parallel relation to one another and for transferring the articles in unscrambled parallel relation to a second or receiving location, is disclosed. The magazine comprises a partitioned housing defining a plurality of similar, open-bottomed chambers adjacent to, but isolated from, one another. Each of the chambers has a uniformly narrow dimension corresponding to the width of any of the aforementioned articles to provide loose lateral support for a selected number of the articles in a stacked array, with one such article upon the next. Each of the stacked arrays is releasably supported in its respective chamber by a respective elongate pin which can be laterally withdrawn from its corresponding chamber to allow the articles to fall as a batch and without losing their parallel disposition onto a receiving device, e.g., a hopper.

13 Claims, 8 Drawing Figures

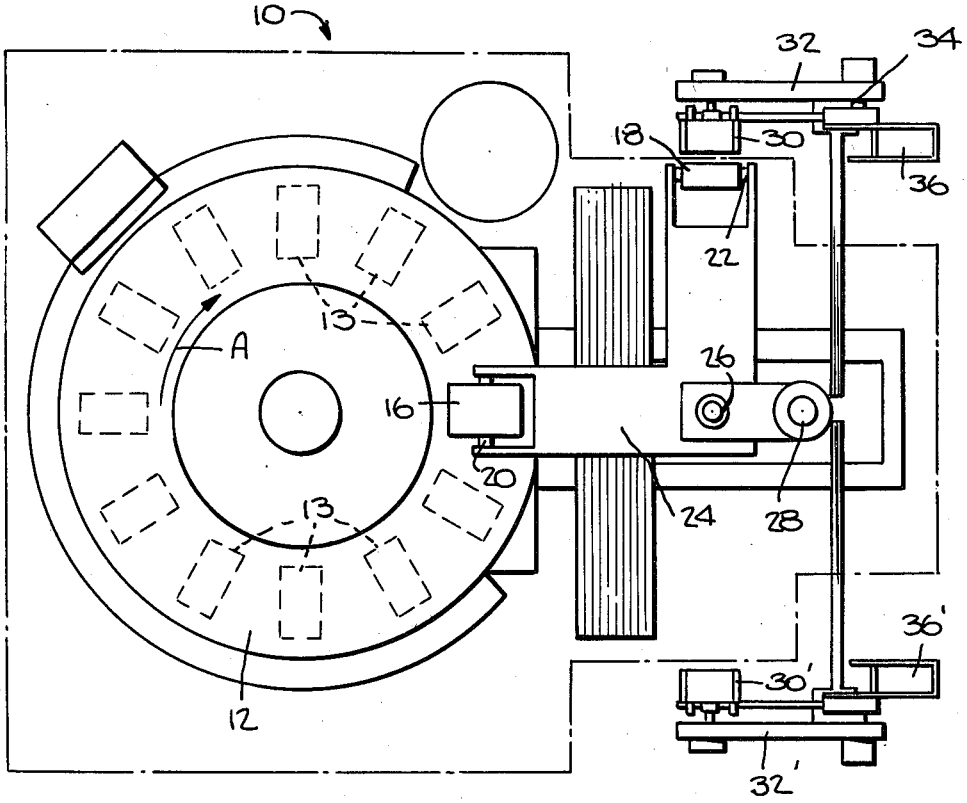
Fig. 1.
Fig. 2.
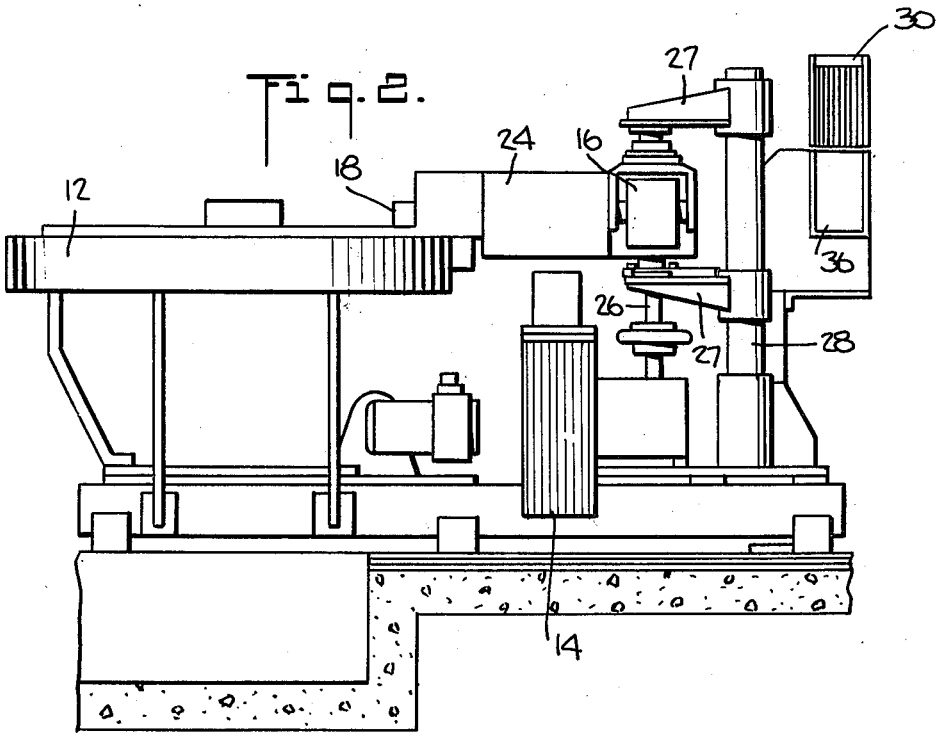

114
110
116
68
64
62
54
68
66
50
74
70
74
70
76
76
82
100
72
84
98
106
86'
52
106
104
102
80
78

MAGAZINE FOR TRANSFERRING ROD-SHAPED ARTICLES

This application is a continuation-in-part of our prior copending application Ser. No. 738,489 filed Nov. 3, 1976 now abandoned.

BACKGROUND OF THE INVENTION

The present invention relates generally to the art of transferring a plurality of parallel, elongate, generally rod-shaped articles from a first to a second location without any substantial disturbance of the parallel orientation of such articles. Although the invention is of fairly general utility, the following description will be couched in the first instance in terms of a device used in a crayon-manufacturing system for transferring batches of crayons from one type of crayon-holding mechanism to another.

Generally speaking, crayons may be fabricated or manufactured by various means. One such means is the machine disclosed in U.S. Pat. No. 3,957,408, issued on May 18, 1976, which is assigned to the same assignee as the instant application and the subject matter of which is hereby incorporated herein by reference. This machine utilizes a rotating mold table having a plurality of multi-cavity molds into which a suitable wax material in molten state can be introduced for being shaped into the form of batches of parallelly oriented crayons. Such a machine, however, requires means by which the respective batches of crayons extracted from the molds can be transferred, while still parallel, to other locations for storage or for further processing, e.g., labelling and packaging for sale.

SUMMARY OF THE INVENTION

Primarily, therefore, it is an object of the present invention to provide a device for receiving a plurality of elongate rod-shaped articles, such as crayons, from a first or source location where the articles are arranged in a parallel relation and for transferring such articles to a second or receiving location, such as a hopper, while the articles are still in unscrambled parallel relation with one another.

It is another object of the present invention to provide such a device in the form of a magazine or multi-chamber housing that substantially does not alter the parallel disposition of a batch of such articles that is transferred therein to form the source location.

It is still another object of the present invention to provide a magazine as aforesaid that can be readily dismantled, in part or in entirety, to facilitate cleaning of the interior thereof after various intervals of use.

Basically, the present invention may be characterized as a mechanism for transferring elongate rod-shaped articles from one location to another without substantially disturbing the parallel orientation of the articles. In a crayon manufacturing environment, therefore, the present invention provides a mechanism which is utilized for automatically transferring each batch of crayons from the mold, from which they are extracted in parallel relation with each other, to a receiving location, e.g., a hopper, in such a fashion that all of the crayons remain in unscrambled parallel relation with one another during the entire crayon-transferring operation, including their deposition in the hopper. The article-holding component of the mechanism is a magazine in the form of a housing that is provided with partition means for defining a plurality of similar open-bottomed chambers adjacent to, but isolated from, one another, each of the chambers having a uniformly narrow dimension corresponding to the width of the articles to provide loose lateral support for a plurality of such articles in a stacked parallel array, and the group of articles in each chamber resting one upon the next.

Associated with the partition means is support means movably disposed in each of the chambers for releasably supporting each of the aforementioned stacked arrays of articles against gravitational fall, and control means that is operatively associated with each of the support means for withdrawing all of the same simultaneously with one another from their respective chambers, thereby to release each of the stacked arrays for gravitational fall through the open bottom of its corresponding one of the chambers to a receiving location, e.g., into a hopper.

BRIEF DESCRIPTION OF THE DRAWINGS

The foregoing and other objects, characteristics and advantages of the present invention will be more clearly understood from the following detailed description thereof, as applied to a crayon-manufacturing environment, when read in conjunction with the accompanying drawings, in which:

FIG. 1 is a schematic plan view of a crayon-fabricating apparatus along with which an article-transfer magazine according to the present invention is employed;

FIG. 2 is a schematic side elevational view of the apparatus illustrated in FIG. 1;

DETAILED DESCRIPTION OF THE INVENTION

Overall Machine

Figure 3:
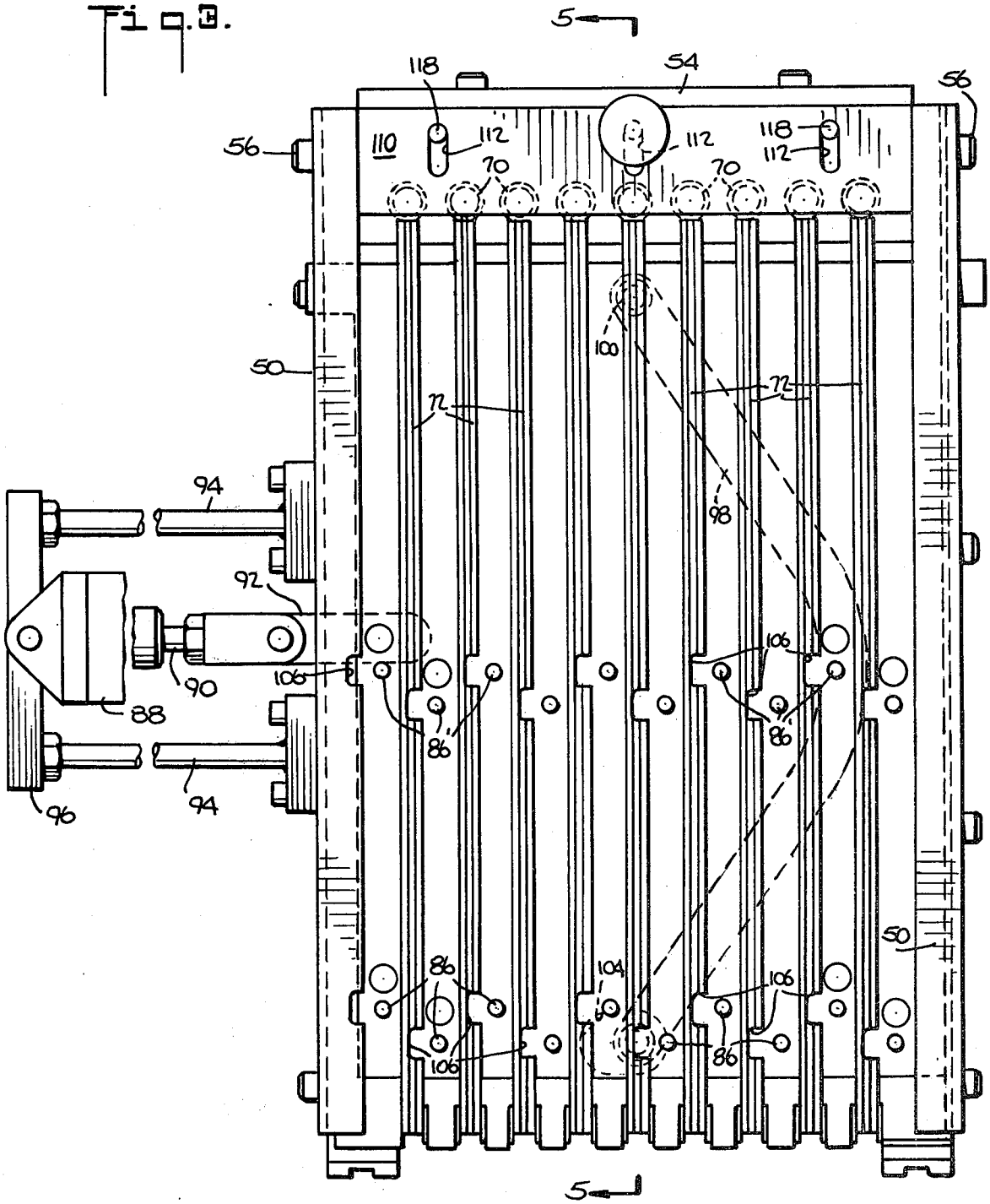
FIG. 3 is an enlarged front elevational view of a crayon magazine according to the present invention.

Referring now to the drawings, and more particularly to FIGS. 1 and 2 thereof, for purposes of illustration only, the present invention will be described as a component, along with other devices, of an apparatus or machine in which crayons are molded and then transferred from the mold section of the machine to a receiving location or hopper. The section of the machine for molding the crayons from a wax-like material is denoted generally by the reference character 10 and surrounded by a box illustrated in broken lines (FIG. 1).

Such apparatus 10 is of the type, for example, disclosed in the aforesaid U.S. Pat. No. 3,957,408. Briefly, the apparatus 10 includes a rotary mold table 12, of circular configuration, in which are arranged in circumferential succession a plurality of compartments or molds 13 in which wax-like material can be formed into the typical crayon shape. Although not shown, each of the compartments or molds 13 is provided, for example, with upwards of one hundred vertical, parallel, crayon-shaped mold tubes or cavities. The table 12 rotates generally clockwise, in the direction of arrow A, so that its various compartments in succession can be supplied with the wax-like material, for example, by a wax supply unit 14 (FIG. 2).

As the mold table 12 continues to turn, the wax-filled cavities are moved through a cooling zone where they are solidified. Eventually each of the molds arrives in an ejection zone at a position just beneath the location of a crayon-receiving device into which all of the crayons of a particular mold can be transferred by an ejection device (not shown), all as disclosed in U.S. Pat. No. 3,957,408. Preferably, two receivers 16 and 18 are provided, the receivers being rockably mounted on respective horizontal stub axles 20 and 22 arranged at the extremities of a generally L-shaped frame 24 that is pivotally mounted upon a vertical axle 26 supported by a pair of brackets 27 (FIG. 2) which in turn are supported by a vertical post 28. The receivers 16 and 18 can thus be moved in an alternating sequence to a position overlying the mold table 12 (the receiver 16 is shown in this position in FIG. 1 and the receiver 18 in FIG. 2) for receiving from successive ones of the molds 13 respective batches of crayons.

All the crayons of each such batch of crayons when the same are ejected from the respective mold are deposited into and then retained by the receiver 16 or 18 in the very same parallel relation as that of the mold tubes or cavities in the mold. To facilitate this, as shown in U.S. Pat. No. 3,957,408, the arrangement of the cavities, e.g., in rows and columns, in each mold corresponds exactly to the arrangement of the crayon-receiving chambers in each of the receivers 16 and 18.

In the position of the L-shaped frame 24 illustrated in FIG. 1, the receiver 18 is disposed opposite a crayon magazine of the present invention denoted generally by the reference character 30. The magazine 30 is arranged on an arm 32 (omitted from FIG. 2 for the sake of simplicity) that is mounted for swinging movement in a vertical plane about an axis 34 from the position illustrated in FIG. 1, where the magazine is located opposite the receiver 18, to the position illustrated in FIG. 2 where the magazine is located above a hopper 36. In the condition illustrated in FIG. 1, therefore, the magazine 30 is capable of receiving a batch of crayons from the receiver 18. The transfer of the batch of crayons from the receiver 18 to the magazine 30 is effected by suitable ejector means (not shown) also described in the aforementioned U.S. Pat. No. 3,957,408.

As illustrated in FIG. 1, the apparatus also includes a second crayon transfer line, including a magazine 30', a magazine-shifting pivotal arm unit 32', and a hopper 36', all the same as the line 30-32-36 discussed above. It is to service both lines that the L-shaped frame 24 can be oscillated between two positions ninety degrees apart so that, alternatingly, the receiver 16 is being loaded with crayons above the rotary mold table 12 while the receiver 18 is being emptied into the magazine 30 at the arm unit 32, and the receiver 16 is being emptied into the magazine 30' at the arm unit 32' while the receiver 18 is being loaded with crayons at the mold table.

CRAYON MAGAZINE

Figure 4:
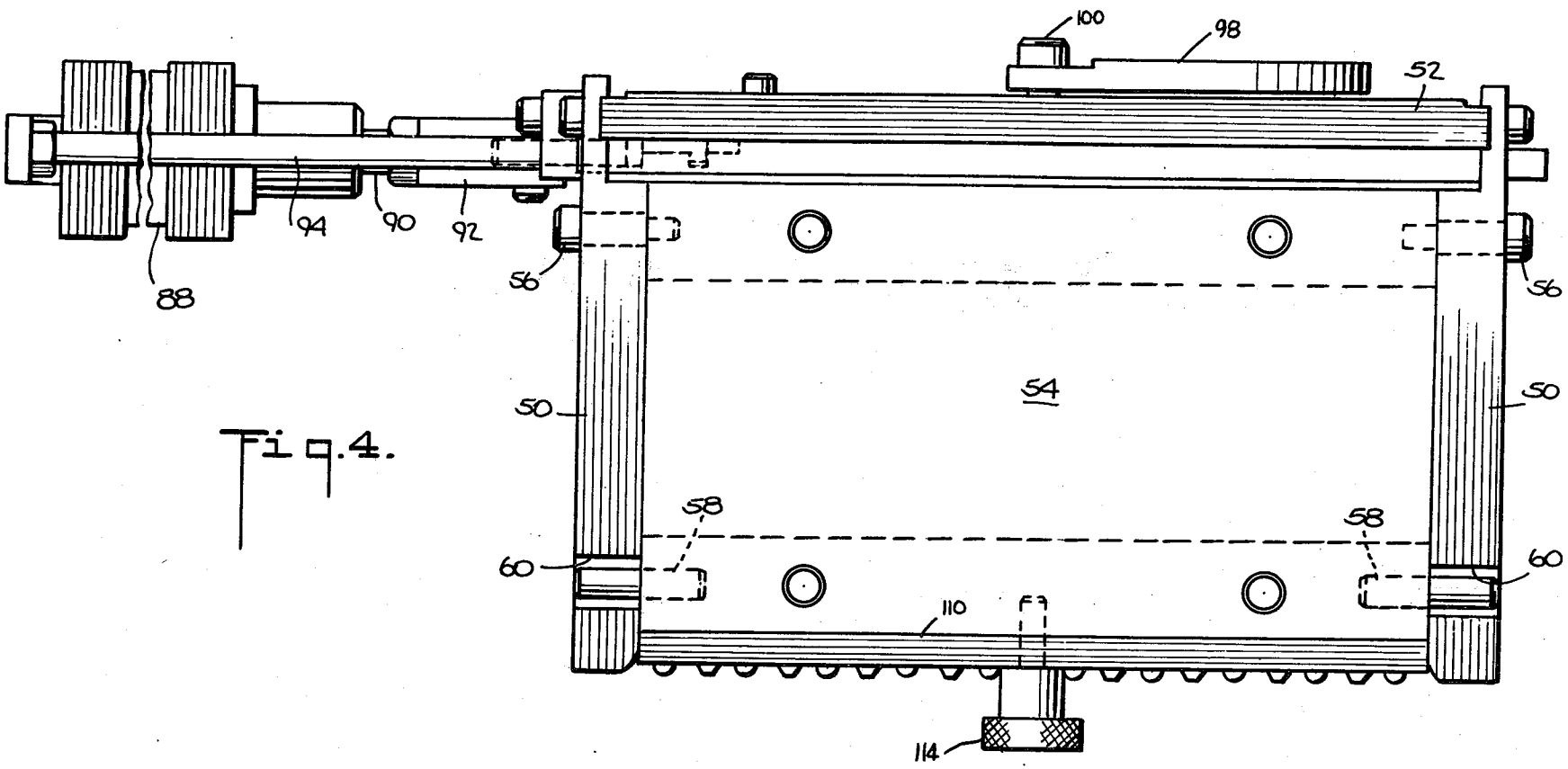
FIG. 4 is a top plan view of the magazine illustrated in FIG. 3.
Figure 5:
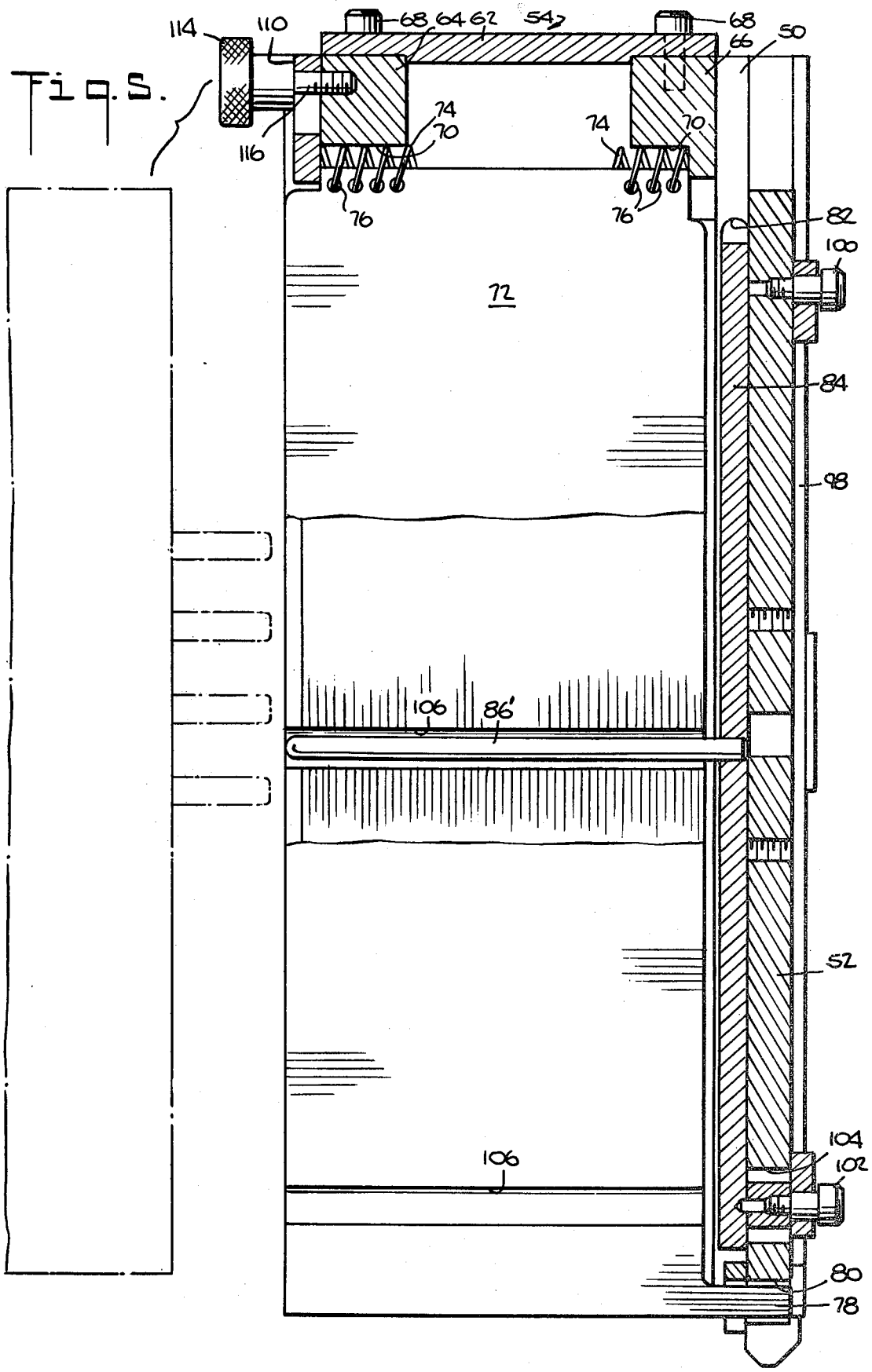
FIG. 5 is a sectional view taken along the line 5—5 in FIG. 3, some parts being broken away to show further details.

Referring now to FIGS. 3–5, the magazine 30 (and only it will be described, as both magazines are identical in construction) is generally box-like in configuration and includes a pair of side walls 50 interconnected to one another by a back wall 52. Pivotally connected to the side walls 50 is a cover member 54. In this regard, each of the side walls 50 is provided with a pin 56 that hingedly supports the rear edge portion of the cover member 54 adjacent to the back wall 52. The front edge portion of the cover member 54 is provided with a pair of oppositely extending pins 58 that are adapted each to radially engage and fit into a respective notch 60 formed in the upper portion of each of the side walls 50. Radial engagement of the pins 58 with the notches 60 is effected when the cover member 54 is pivoted downwardly about the rear pins 56. The cover member 54 is provided with a top plate 62 to which are fixedly connected a front member 64 and a rear member 66 such as by bolts 68 (FIG. 5). As is clear from FIG. 4, the pins 56 project into the rear member 66 of the cover member 54.

The front member 64 and rear member 66 are each provided with a horizontal array of parallel notches 70, with the notches of each array being in axial alignment with the corresponding notches of the other array. Each of these notches has an upper closed end that is wider than its lower open end. Preferably, the notches 70 are substantially circular in cross-section. Each of the notches 70 is adapted to suspend a respective vertical partition plate 72.

In this regard, each of the partition plates 72 is provided at its upper edge portion with, for example, a pair of springs 74. The runs of the springs helically project through respective apertures 76 formed along the upper edge portion of each of the partition plates 72. One spring 74 of each pair fits into a corresponding notch 70 in the front member 64, whereas the other spring of each pair fits into a corresponding notch in the rear member 66.

In this manner, the partition plates 72, when suspended by the members 64 and 66 of the cover member 54, define therebetween a series of chambers for receiving the crayons to be transferred, with each plate being spaced from its neighbor by a distance corresponding to the thickness of the crayons to be received in the chambers. In order to enable the plates 72 to remain suspended in substantially parallel relation and in order to reinforce and stabilize each of the parallel partition plates, the latter at their respective bottom edge portions are each provided with a horizontally and rearwardly projecting flange 78 that is adapted to be inserted into a corresponding one of a plurality of notches 80 formed in the bottom of the back wall 52.

As best illustrated in FIG. 5, each of the side walls 50 is provided with a narrow, vertically elongate opening 82 in which is disposed, for horizontal displacement, a pin plate 84. The pin plate 84 has affixed to it, in substantially perpendicular relation therewith, two sets of pins, namely, a lower set 86 and an upper set 86'. The pins of each of the sets of such pins are staggered slightly vertically relative to one another, as illustrated in FIG. 3, and are disposed midway between respective pairs of the partition plates 72 when the pin plate 84 is in a position as illustrated in FIG. 3.

Associated with the pin plate 84 is a power cylinder 88 having a piston rod 90 and appropriate connecting links 92 that interconnect the pin plate 84 to the piston rod 90 through the vertically elongate opening 82 formed in the left-most side wall 50. The power cylinder 88 is articulated at its blind end to a cross-head 96 which in turn is rigidly secured to the leftmost side wall 50 through the intermediary of suitable tie rods 94.

The pin plate 84 is also supported by a bent link 98 (shown in phantom in FIG. 3) that is pivotally connected at its upper end portion to the external surface of the back wall 52 by a pin 100. The lower end portion of the link 98 is provided with a pin 102 (FIG. 5) that projects through a horizontally elongate slot 104 formed in the back wall 52, the pin 102 in turn being pivotally connected to the bottom edge portion of the pin plate 84. Thus, the link 98 is adapted to pivot about the pin 100. As it does, the lower pin 102 swings from one end to the other of the horizontally elongate slot 104 and functions to limit the extent of horizontal displacement of the pin plate 84 as the piston rod 90 of the power cylinder 88 is protracted and retracted.

When the piston rod 90 is protracted, the right end of the horizontally elongate slot 104 (as shown in FIG. 3) limits the displacement of the pin plate 84 to the right such that its pins 86 and 86' are substantially medially disposed between the partition plates 72, i.e., in respective first positions in which they underlie respective columnar sections of the chambers defined between the various pairs of partition plates. On the other hand, when the piston rod 90 is retracted, the left end of the horizontally elongate slot 104 limits the displacement of the pin plate 84 to the left. In this regard, each of the partition plates 72 is provided with two vertically spaced horizontal recesses 106, as is the leftmost side wall 50, to accommodate the respective pins 86 and 86' and enable these to be entirely removed from their positions obstructing the chambers between the respective pairs of the partition plates 72 when the piston rod 90 is retracted.

In order to prevent the partition plates 72 from inadvertently being pulled free from their associated notches 70 formed in the members 64 and 66 of the cover member 54, there is provided a retaining plate 110 having three vertically elongate slots 112. The retaining plate 110 is fastened to the member 64 of the cover member 54 by means of a knurled knob 114 having a threaded member 116 that can be threaded into an appropriate opening in the member 64. On either side of the knob 114 there is provided a pair of pins 118 that are affixed to the member 64 and project into corresponding ones of the slots 112 to stabilize the retaining plate 110. Thus, when the knob 114 is loosened, the retaining plate 110 can be elevated relative to the member 64, thereby to expose the slots 70 and springs 74 associated with each of the partition plates 72 so that the latter can be withdrawn, while when the retaining plate 110 is displaced downwardly to its lowermost position, it prevents each of the partition plates 72 from being withdrawn. In addition, the entire cover member 54 and its associated partition plates 72 can, in unison, be pivoted upwardly about the rear pins 56 to expose the interior of the magazine at selected intervals, e.g., for cleaning purposes, without separation of the partition plates 72.

Magazine Displacement Mechanism

Figure 7:
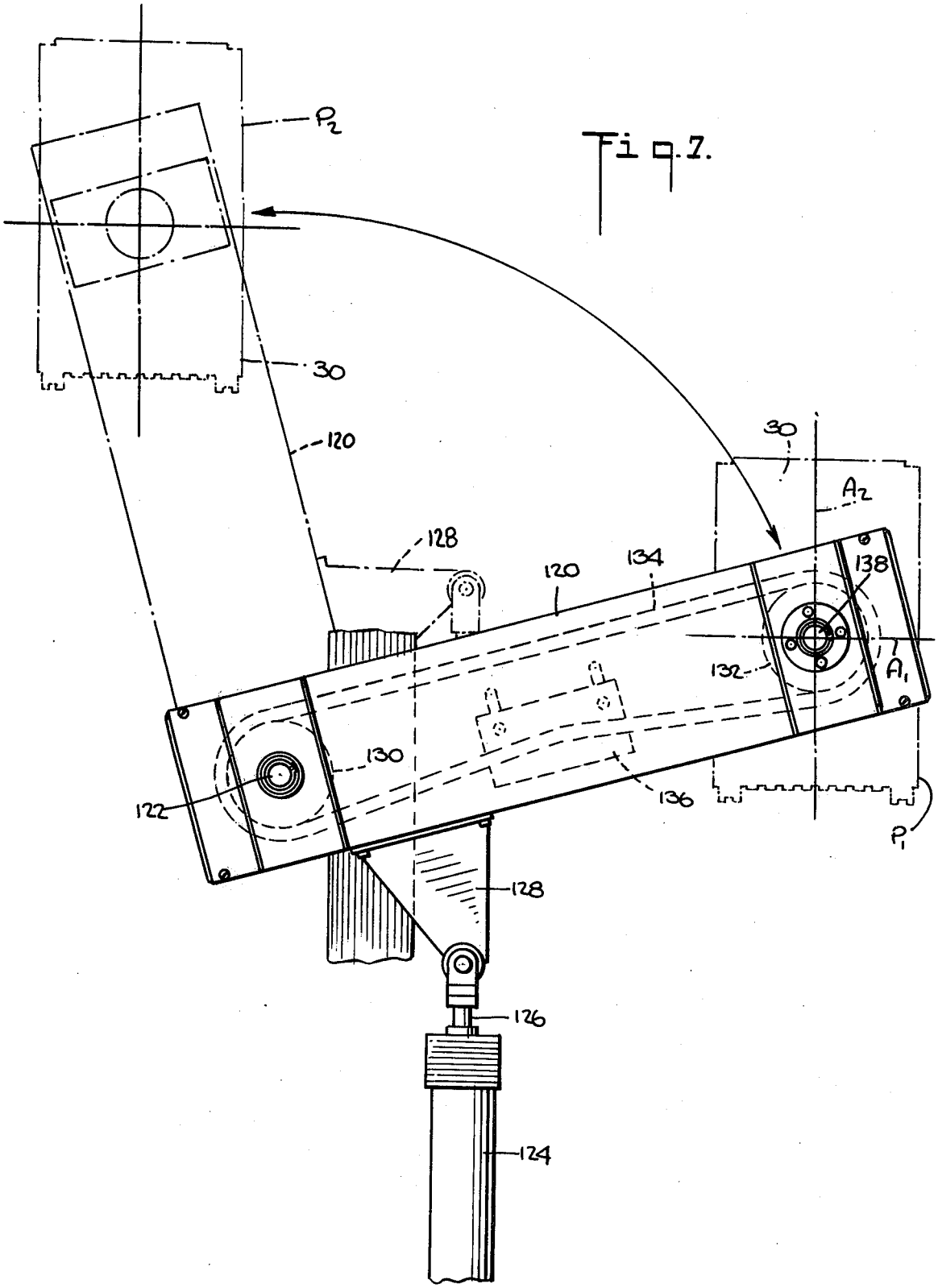
FIG. 7 is an enlarged elevational view of a swing arm mechanism used for displacing the magazine of the present invention from its crayon-receiving position to its crayon-discharging position over a hopper or other receiving location.

Referring now to FIG. 7, the magazine 30, which is here shown in phantom outline only, is freely rotatably mounted upon an arm 120 (reference character 32 in FIG. 1) that is angularly displaceable vertically. The magazine 30 thus is associated with the arm 120 in such a fashion that the orientation of the magazine always remains unchanged as the arm 120 is pivotally displaced. In this regard, the minor or horizontal axis $A_1$ and the major or vertical axis $A_2$ of the magazine 30 always remain horizontally and vertically oriented, respectively, as the arm 120 is rocked from the position illustrated in solid lines in FIG. 7 to the position illustrated in broken lines in FIG. 7.

The arm 120 is journalled upon a horizontally disposed axle 122 (reference character 34 in FIG. 1) that itself is affixed to an appropriate stationary support. The arm 120 is also associated with a vertically oriented power cylinder 124 whose piston rod 126 is vertically displaceable and articulated or linked to a bracket 128 that in turn is affixed to the arm 120. Thus, as the piston rod 126 is alternately protracted and retracted, the arm 120 is caused to move alternately counter-clockwise and clockwise, respectively, from the position illustrated in solid lines in FIG. 7 to the position illustrated in broken lines, and vice versa.

In order to prevent the magazine 30 from undergoing a change in its orientation as it is swung between the positions $P_1$ and $P_2$ corresponding to the respective arm locations, the magazine is associated with a pair of pulleys or sprockets 130 and 132, respectively, and an endless belt or sprocket chain 134 the tension of which is controlled by the adjustment of a slotted tension control member 136. The pulley 130 is arranged so that it remains stationary as the arm 120 is rocked in one direction or the other. The pulley 132, on the other hand, is fixedly secured to the magazine 30 and arranged to idle freely relative to the arm 120 upon an axle 138. Thus, as the arm 120 is pivoted either clockwise or counter-clockwise, the arm 120 turns relative to the stationary pulley 130. This causes the chain 134 to move relative to the arm 120 and thereby to turn the pulley 132 (and the magazine 30) in the appropriate sense by an amount that is sufficient to prevent the magazine from undergoing a change in its orientation, i.e., so that the minor horizontal axis $A_1$ of the magazine 30 always remains horizontal and the major vertical axis $A_2$ of the magazine 30 always remains vertical as the arm 120 is rocked about the axle 122 by the air cylinder 124.

Magazine Operation

In operation, at the start of a transfer cycle, the magazine 30 supported on the arm 120 is empty and in a position denoted by the reference character $P_1$ in FIG. 7. At this time, the chambers defined by respective pairs of the partition plates 72 are aligned with the various crayon-holding tubes in the receiver 18. The crayons disposed in those tubes are then ejected from the receiver 18 into the chambers of the magazine 30. The arrangement is such that the crayons are loaded into the chambers of the magazine 30 simultaneously in two groups; for example, assuming a batch of 110 crayons and 10 chambers in the magazine, one such group made up of sixty crayons in sets of six each rests upon the staggered upper pins 86', whereas the other group made up of fifty crayons in sets of five each rests upon the staggered lower pins 86. The crayons in each chamber thus are stacked in parallel relation upon one another, with the various sets in each group being disposed in staggered fashion as illustrated in FIG. 6.

Figure 6A:
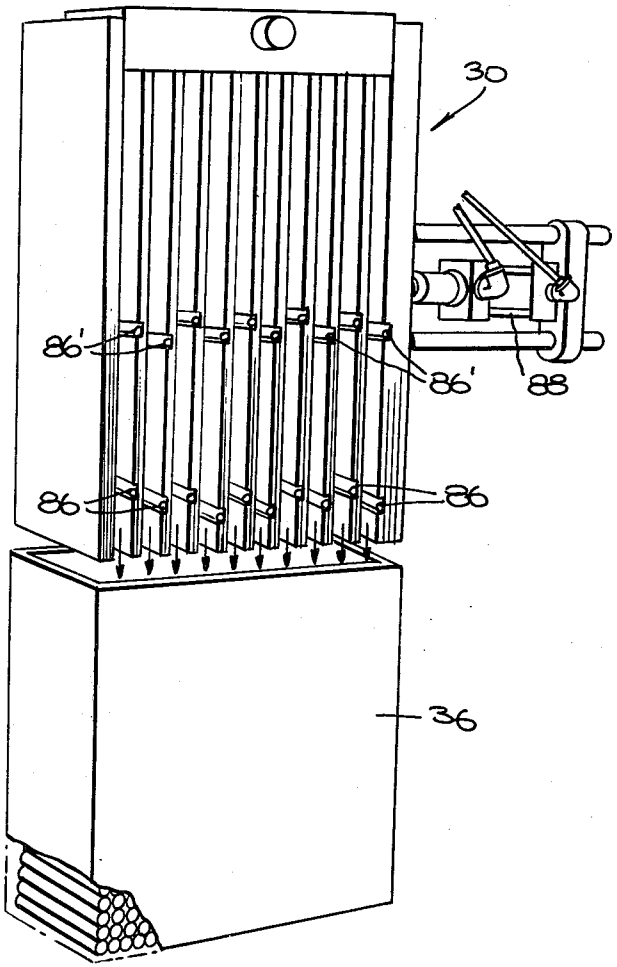
FIGS. 6 and 6A are schematic illustrations of the magazine of the present invention in the crayon-retaining and crayon-discharging stages of the operation thereof.
Figure 6:
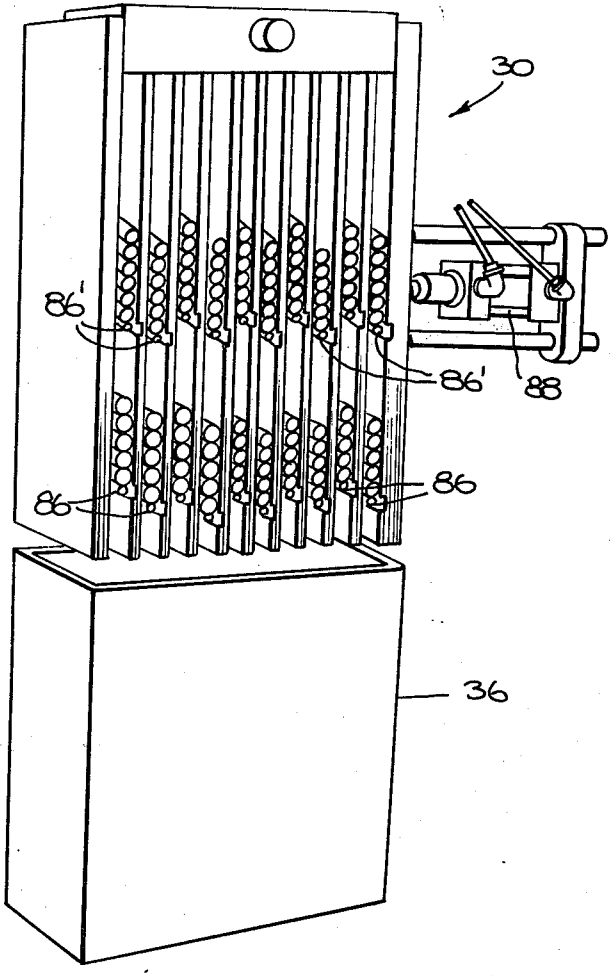

The arm 120 is then swung up by the piston and cylinder combination 124–126 (FIG. 7) through an arc of about 90° to bring the crayon-filled magazine 30 into its discharge position $P_2$ above the hopper 36 (FIG. 6). As the arm 120 reaches the end of its upward movement, a suitable sensing element (not shown) is activated which in turn causes the air cylinder 88 associated with the magazine 30 to retract the piston rod 90 and thereby to shift the pin plate 84 to one side. This causes the pins 86 and 86' under the various sets of crayon stacks in the chambers of the magazine to be laterally displaced to their respective second positions in which the pins are out of underlying relation to the crayon-receiving columnar sections of the magazine chambers, i.e., into the associated recesses 106 provided in the partition plates 72. With the pins so withdrawn from under the crayons, the latter fall downwardly as a batch (FIG. 6A) into the hopper 36, and ultimately come to rest therein, with the individual crayons having remained in substantially unscrambled parallel relation to one another.

Once the crayons have come to rest on the bottom of the hopper, air pressure is admitted into the rod end of the cylinder 124 which causes the arm 120 to be swung down so as to shift the magazine 30 away from its crayon-discharge location above the hopper and back to its crayon-receiving location adjacent the discharge location of the receiver 18. When the arm 120 reaches this position, shown in solid lines in FIG. 7, the mechanism is again in its starting position. Concomitantly with the empty magazine 30 being recycled to the receiver location for reloading with additional crayons from the receiver 18, of course, the air cylinder 88 is activated to protract the piston rod 90 and thereby shift the pin plate 84 back to its starting position so as to return the pins 86 and 86' in their respective chambers to their crayon-supporting positions (FIG. 3) between the vertical partition plates 72. The magazine 30 is then again conditioned for being replenished with additional crayons.

As previously mentioned, the very same operational sequence as so far described for the magazine 30 is also followed by the magazine 30' in transferring crayons from the receiver 16 to the hopper 36', but in tandem or an alternating sequence with the operation of the magazine 30. A more detailed description of the operation of the magazine 30' thus is not deemed necessary and will not be undertaken herein.

It will be understood, of course, that although the invention has been described hereinabove as applied to the transfer of crayons, it is equally applicable to the transfer of other comparably shaped articles, including both solid and hollow or tubular articles as well as articles of other than round cross-section configuration. By the same token, it should be understood that the foregoing description of the present invention has been for purposes of illustration only, and that the various structural and operational features of the magazine and its adjuncts herein disclosed are susceptible to a number of modifications and changes none of which entails any departure from the spirit and scope of the present invention as defined in the hereto appended claims.

What is claimed is:

1. A magazine for receiving elongate similar articles from a source retaining said articles in a predetermined parallel array and for transferring said articles to a collector in unscrambled parallel relation with one another, said magazine comprising:

(a) partition means defining a plurality of open-bottomed chambers adjacent to, but isolated from, one another, each of said chambers corresponding in width to the width of any of said articles so that the associated partition means thereby provide loose lateral support for a selected number of said articles in a stacked array, with one said article upon the next;

(b) support means movably disposed in each of said chambers for releasably supporting each said stacked array against free gravitational fall; and (c) control means operatively associated with said support means for withdrawing all said support means simultaneously with one another from their respective chambers and for thereby releasing each said stacked array for free gravitational fall through the open bottom of its respective one of said chambers.

2. A magazine as claimed in claim 1, wherein said partition means includes a plurality of independently movable plates, and means are provided for disposing said plates in spaced, parallel relation to each other and for releasably stabilizing said plates against movement relative to one another.

3. A magazine as claimed in claim 2, wherein said last-named means includes a pair of opposing side walls between which said plates are disposed, a back wall bridging and fixedly interconnecting said side walls, and plate-retaining means bridging said side walls and detachably suspending said plates in said spaced, parallel relation to each other.

4. A magazine as claimed in claim 3, wherein said plate-retaining means includes a plurality of spaced, parallel slots each having a relatively wider, upper, closed portion and a relatively narrower, lower, open portion, and each of said plates includes means on an upper edge portion thereof cross-sectionally complementing and insertable into respective ones of said slots for detachable retention by the latter.

5. A magazine as claimed in claim 4, further including pivot means connecting said plate-retaining means to said side walls for selective pivotal displacement relative to the latter.

6. A magazine as claimed in claim 3, wherein said support means includes a plurality of elongate pins extending horizontally in each of said chambers between respective pairs of said partition plates, and a vertical pin plate extending parallel to said back wall and between said side walls, said partition plates each having a rear edge terminating just short of said vertical pin plate, said pins being affixed to said vertical pin plate in substantially perpendicular relation therewith, and said pin plate being shiftably supported by said back wall for reciprocal movement substantially horizontally between said side walls and relative to said rear edge of each of said partition plates.

7. A magazine as claimed in claim 6, wherein each of said partition plates includes at least one elongate recess juxtaposed to a corresponding one of said elongate pins, for enabling lateral withdrawal of said pins from their article-supporting positions in said chambers and into said recesses upon shifting of said vertical pin plate in one horizontal direction.

8. A magazine as claimed in claim 7, wherein said control means includes power cylinder means affixed to one of said side walls externally of the latter, and a protractable-retractable piston rod actuable by said power cylinder means and operatively connected with said vertical pin plate for reversibly shifting the latter horizontally on said back wall.

9. A magazine as claimed in claim 8, said control means further including a link located exteriorly of and pivotally connected at one end to said back wall, said back wall having a horizontally elongate slot therein adjacent to the opposite end of said link, and bolt means affixed to said opposite end of said link, said bolt means projecting through said horizontally elongate slot and being pivotally connected to said vertical pin plate.

10. A magazine as claimed in claim 6, wherein each of said partition plates includes a lower end portion releasably engaged with a lower end portion of said back wall in tongue-and-groove fashion beneath said vertical pin plate.

11. A magazine as claimed in claim 1, wherein said chambers are, apart from said support means, devoid of any additional means for supporting said stacked arrays.

12. A magazine for receiving elongate similar articles from a source retaining said articles in a predetermined parallel array and for transferring said articles to a collector in unscrambled parallel relation with one another, said magazine comprising:

(a) a plurality of partition means defining therebetween a plurality of open-bottomed chambers adjacent to, but isolated from, one another, each of said chambers from one of its associated partition means to the other having a substantially uniform width corresponding to the width of any of said articles so that said associated partition means thereby provide loose lateral support for a selected number of said articles in a stacked array, with one said article upon the next;

(b) support means disposed in each of said chambers for movement between (i) respective first positions in which said support means are arranged in underlying relation to respective columnar sections of said chambers for supporting the associated stacked arrays of articles therein against free gravitational fall out of the open bottoms of said chambers, and (ii) respective second positions in which said support means are arranged out of said underlying relation to said columnar sections of said chambers for freeing the same to permit free gravitational fall of said articles out of said chambers, said support means being normally in said first positions thereof; and (c) control means operatively associated with said support means for moving all said support means simultaneously with one another from their first to their second positions and for thereby enabling each said stacked array of said articles to be released for free gravitational fall through the open bottom of its respective one of said chambers.

13. A magazine as claimed in claim 12, wherein said chambers are, apart from said support means, devoid of any additional means for supporting said stacked arrays.

* * * * *